United States Patent [19]

Spiegelberg et al.

[11] 4,281,528

[45] Aug. 4, 1981

[54] PROCESS FOR ISOTHERMALLY SHAPING A TITANIUM-CONTAINING METAL WORKPIECE

[75] Inventors: William D. Spiegelberg, Parma; Donald J. Moracz, Garfield Heights; Frank N. Lake, Mentor, all of Ohio

[73] Assignee: TRW Inc., Cleveland, Ohio

[21] Appl. No.: 928,395

[22] Filed: Jul. 27, 1978

[51] Int. Cl.[3] ..... B21B 45/00

[52] U.S. Cl. ..... 72/46; 72/28; 72/42

[58] Field of Search ..... 72/42, 46, 342, 364; 252/28, 29, 30; 106/38.28, 38.6

[56] References Cited

U.S. PATENT DOCUMENTS

| | | | |
|---|---|---|---|
| 3,154,849 | 11/1964 | Dolch, Jr. | 72/46 |
| 3,254,401 | 6/1966 | Dalton et al. | 252/28 X |
| 3,384,581 | 5/1968 | Peace | 252/28 X |
| 3,411,564 | 11/1968 | Miller, Jr. | 252/28 X |
| 3,575,858 | 4/1971 | Aadan et al. | 252/28 X |
| 3,584,487 | 6/1971 | Carlson | 72/342 X |
| 3,635,068 | 1/1972 | Watmough et al. | 72/342 |
| 3,840,461 | 10/1974 | Espiner | 252/28 X |
| 4,055,975 | 11/1977 | Serfogo et al. | 72/46 |
| 4,096,076 | 6/1978 | Spiegelberg | 72/42 X |

FOREIGN PATENT DOCUMENTS 905989 9/1962 United Kingdom .

OTHER PUBLICATIONS

"Interface Separation-Lubrication Substances for Isothermal Forging at 1300 F to 1500F", Technical Report AFL-TR-77-87.

Technical Report AFL-TR-77-87, to Westinghouse Electric Corp. by TRW "Interface Separation-Lubrication Substances for Isothermal Forging at 1300F to 1500F".

*Primary Examiner*—Leon Gilden

[57] ABSTRACT

There is provided an improved process for isothermal shaping of a titanium-containing workpiece in a hot die. A precoat lubricant composition including a glassy component and a solid lubricant such as graphite dispersed in an organic medium is applied to the workpiece, and the workpiece heated to a temperature sufficient to remove the organic medium to leave a residue of glassy material and graphite on the workpiece. The workpiece is then inserted in a heated split die, and the die loaded to alter the shape of the workpiece. The ratio of the solid lubricant to the glassy component is at least one to one. The particle size of the glassy component is important to the surface character of the finally shaped workpiece.

11 Claims, 1 Drawing Figure

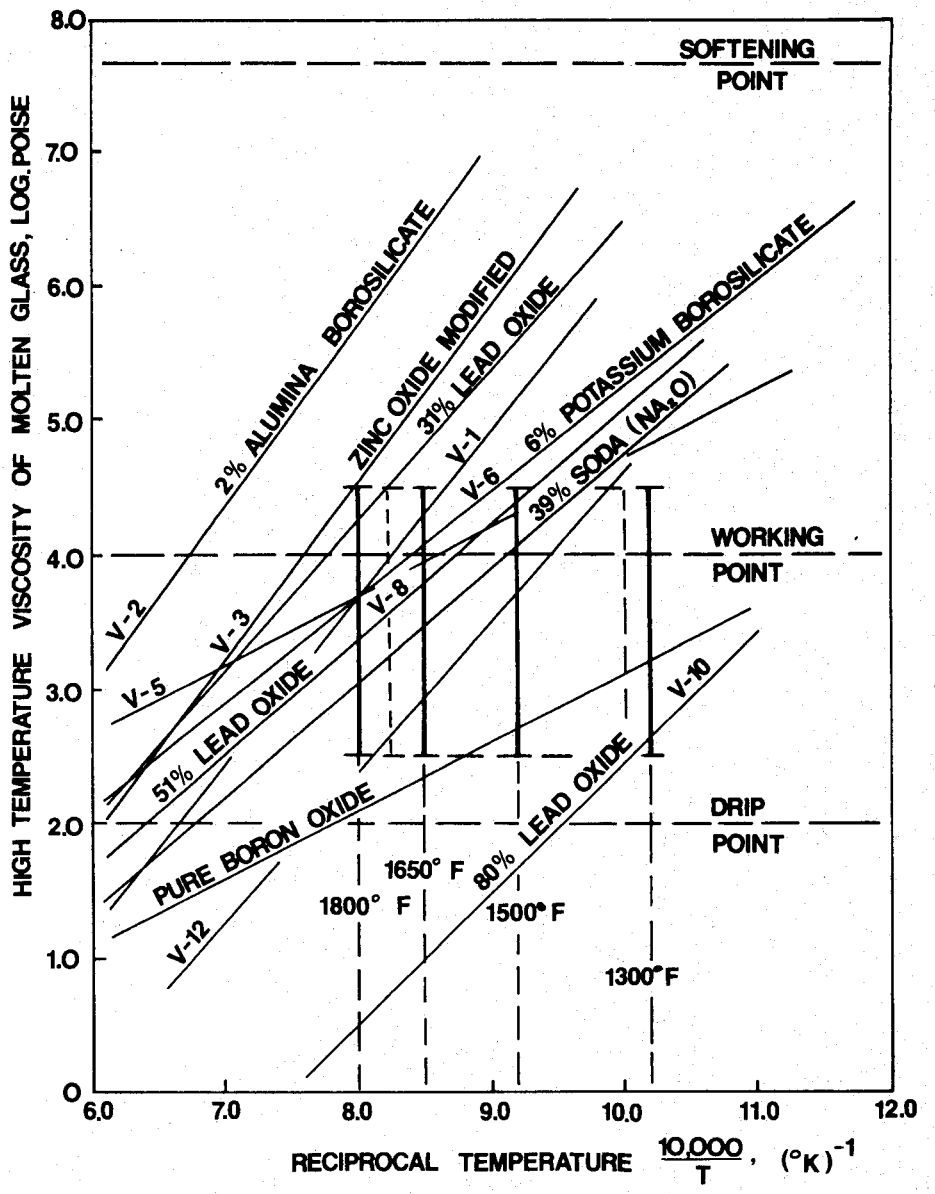
SOFTENING POINT
WORKING POINT
DRIP POINT
2% ALUMINA BOROSILICATE
ZINC OXIDE MODIFIED
31% LEAD OXIDE
6% POTASSIUM BOROSILICATE
39% SODA ($Na_2O$)
51% LEAD OXIDE
PURE BORON OXIDE
80% LEAD OXIDE
V-1
V-2
V-3
V-5
V-6
V-8
V-10
V-12
1800° F
1650° F
1500° F
1300° F
HIGH TEMPERATURE VISCOSITY OF MOLTEN GLASS, LOG. POISE
RECIPROCAL TEMPERATURE $\frac{10,000}{T}$, $(°K)^{-1}$
8.0
7.0
6.0
5.0
4.0
3.0
2.0
1.0
0
6.0
7.0
8.0
9.0
10.0
11.0
12.0

PROCESS FOR ISOTHERMALLY SHAPING A TITANIUM-CONTAINING METAL WORKPIECE

BACKGROUND OF THE INVENTION AND PRIOR ART

The present invention relates to isothermal forging and isothermal sizing of titanium containing workpieces. Isothermal shaping of metal contemplates isothermal forging where substantial amounts of new surface are generated, or isothermal sizing wherein a previously contoured workpiece is brought within predetermined tolerances and wherein the die and the workpiece are heated and maintained at a predetermined temperature during the shaping operation. The dies are made of the so-called superalloy materials which contain substantial amounts of nickel and chromium.

Hot shaping of metal is not new. An important work in this field is the patent to Dolch U.S. Pat. No. 3,154,849 which describes a process including the precoat lubrication of the interface between the die and the metal workpiece with a vitreous composition characterized by the presence therein of silica and lead oxide. The Dolch disclosure relates to impact forging. The lubricant there disclosed is applied as a slurry by spray gun application to the workpiece. An organic precoat medium composed of a solvent and/or a diluent and a resinous vehicle was used to assist application of the lubricant to the workpiece. As the temperature of the workpiece was raised to forging temperature, the organic solvent, e.g., alcohol evaporates and the resinous portion which serves as a temporary binder is ultimately thermally decomposed as the temperature is further increased.

In isothermal forging and sizing, both the die and the workpiece are elevated to the forging or sizing temperature, and rather than impact shaping, a slow steady high pressure is applied by hydraulic means. Isothermal sizing as opposed to isothermal forging refers to a relatively light reduction taken in the workpiece to bring a forged workpiece to final net dimensions and surface finish. Ease of release or separation from the die is vital and accumulation of material from the lubricant or separation compound is not tolerable for an isothermal forging or sizing operation.

Initial forging lubricants in this field were developed as a result of prior experience in incrementally increasing die temperature in conventional forging processes to reduce chilling in workpieces and were composed of graphites suspended in water. It was later discovered that sodium silicate provided a suitable vehicle for graphite, and compositions so produced worked quite well at the higher conventional die temperatures.

As component precision requirements exceeded the capabilities of conventional forging, regardless of die temperature, isothermal processing studies were initiated. In isothermal processing on dies at 1350°–1750° F., graphite even with minor amounts of sodium silicate was found to be ineffective because the die loading had to be so high for substantial metal movement that damage to the die itself was encountered. Also because of the very high die temperatures (1350°–1750° F.) spraying of the lubricant on the dies had to be abandoned in favor of introducing the lubricant on the workpiece as a precoat. It was found subsequently that by increasing the vitreous or glass component in the precoat lubricant, die life was improved and greater metal movement could be achieved. Increasing the glass component in these systems appeared satisfactory up to about 50% glass content. At higher concentrations of glass with a solid lubricant dispersed therein, there was loss in surface integrity which necessitated a machining operation to produce the proper surface on the articles. Glass build up in the dies and component removal from the dies were also problems with high concentrations of vitreous material, i.e., greater than 50%.

Various other lubricant compositions have been tried, some with considerable success such as shown in Ser. No. 653,382 filed Jan. 29, 1976, now U.S. Pat. No. 4,096,076 to Spiegelberg. This composition depends upon boron nitride in an amount less than 50% by weight as a solid lubricant in a boron trioxide containing vitreous phase most applicable to large "near-net" titanium components that are later machined all over.

In summary, the prior art in providing a lubricating composition for hot forging techniques has proceeded with the concept of a minor amount of a relatively soft dry lubricant, e.g., graphite and/or boron nitride, suspended in a fused glasslike vehicle. Problems have been encountered in isothermal hot forging techniques with effectiveness of the lubricant, pressure required to move considerable amounts of metal, build up of lubricant in the die, poor surface characteristics of the finished piece, etc. Moreover, prior art compositions have been found to have a narrow thermal spectrum, e.g., about 150° F., over which they are useful.

The present invention is concerned with improved glass-graphite compositions utilizing in equal or major amount of solid lubricant for use an isothermal forging or sizing operations. These improved coating compositions demonstrate, for example, with titanium or titanium alloy workpieces, desirable properties in the hot forging or sizing thereof. The high concentration of graphite exerts a self cleaning effect on the dies and greatly alleviates the problem of glass build-up in the dies. The workpiece separates better from the dies and is substantially free of "orange peel" or "egg shell" or other surface texture blemishes. Limiting of the particle size of the glass component appears to be responsible for the improved performance even though the glass is a liquid vehicle for the graphite under forging or sizing conditions. These compositions also have a favorable influence on the die loading because they reduce the force required to effect shaping. This results, in turn, in improved die life.

It has been found that reduction of the particle size of the glass component results in the foregoing improvements, and in particular has a critical influence on the surface characteristics of the finished workpiece. Isothermal sizing and/or forging procedures utilizing a graphite-glass lubricant composition where the graphite is present by weight in an amount equal to or greater than the amount of vitreous component and a commercially available vitreous component having a particle size of approximately 60 mesh has been tried. Lubricants containing this glass component resulted in finished pieces which were characterized by surface blemishes rendering them commercially unsuitable. When the isothermal forging or sizing procedure was improved to utilize lubricants containing a glass component wherein the particle size thereof had been reduced below 200 mesh, commercially satisfactory products were produced.

Reference may be had to the patent to Watmough et al. U.S. Pat. No. 3,635,068 for a disclosure of hot forging of titanium and titanium alloy workpieces utilizing glass and glass-graphite lubricant compositions.

SUMMARY OF THE INVENTION

Briefly stated, the present invention is in a process for isothermally shaping a metal workpiece in a hot die. The process includes the steps of providing a precoat lubricant composition which is a liquid dispersion of a vitreous component and graphite in a solution of an organic solvent and a resin binder soluble in the solvent. In the dispersion, the particle size of the vitreous component and the graphite is less than 200 mesh, U.S. Standard sieve size. The weight ratio of the graphite to the vitreous component ranges from 1:1 to 9.5:1. The workpiece is coated with the precoat lubricant composition, as by spraying, and the workpiece heated to a temperature sufficient to volatilize the organic solvent and thermally decompose the resin binder to leave a residue of vitreous material and graphite on the workpiece. The preheat temperature with titanium and titanium alloy workpieces is between 1000° and 1400° F. The hot workpiece is transferred to a preheated die system, a temperature of from 1350° F. to 1750° F. is attained and the die loaded as by hydraulic means to alter the shape of the workpiece.

Throughout the specification, reference will be had to a "separation lubricant composition" and to a "precoat separation lubricant composition". The "separation lubricant composition" will be understood as that which remains at the interface between the hot workpiece and the preheated die at the time of forging or sizing. The "precoat separation lubricant composition" will be understood as that composition which is applied to the workpiece prior to preheating the workpiece, and which upon preheating the workpiece is changed by evaporation and decomposition into the "separation lubricant composition".

DETAILED DESCRIPTION OF THE INVENTION AND SPECIFIC EXAMPLES

As indicated above, the lubrication and separation compositions useful in accordance with the present invention are characterized by two principal ingredients; namely, a vitreous component and a solid lubricant material such as graphite or boron nitride, or mixtures of graphite and boron nitride. Graphite is preferred. Boron nitride tends to accumulate in the dies and is, therefore, less desirable than graphite.

THE VITREOUS MATERIAL

Broadly speaking, the vitreous material comprising the vitreous component of the present invention must be a liquid throughout the range of shaping temperatures. For most purposes, forging and sizing temperatures as contemplated by the present invention utilizing high concentrations of graphite are in the range from about 1350° F. to about 1750° F. The upper end of this temperature range is particularly useful with the alpha and the alpha-beta titanium alloys whereas the lower end is particularly useful with the beta titanium alloys. Of course, the upper end temperature is limited by the superalloy die material and by any metallurgical transformations that may occur in the workpiece alloys. The vitreous component must be a liquid at whatever temperature within the foregoing range is utilized to effect shaping. Normally, the vitreous material is a solid at ordinary temperatures and remains so to temperatures of 800° F. Accordingly, the vitreous component is one which fuses at a temperature below the temperature of the hot die during shaping and above 800° F.

Chemically, the vitreous materials are generally a mixture of metal oxides, a primary example thereof being silicon dioxide, $SiO_2$. While some simple oxide materials such as silicon dioxide, boron trioxide, and the like may be used, most frequently the metal oxides are complex metal oxides or mixtures of metal oxides. Typical examples of vitreous materials which may be used in accordance with this invention include 2% alumina borosilicate glass, zinc oxide modified glass, 31% lead oxide-silicate, 51% lead oxide silicate, 80% lead oxide-silicate, boron trioxide, 6% potassium borosilicate, 39% sodium oxide-silicate, etc. The number of metal oxide complexes and compositions which may be used in accordance with the present invention are innumerable, and it has been found at the most useful way of describing the limits of useful materials is by means of a "forging window".

Reference may be had to the annexed drawing which illustrates the "forging window" concept. This concept is particularly applicable to the isothermal forging and sizing of titanium or titanium alloys, including beta titanium alloys, in dies formed of nickel and chromium-containing "super alloys". The latter alloys are well known to those skilled in the art and form no part of the present invention other than the fact that the lubricating and separating compositions of the present invention are particularly useful therewith.

For most purposes, the logarithm of the viscosity of the molten vitreous components measured in poises for hot or isothermal forging procedures should be between the drip point of 2 and the most convenient working point which is about four. The desired range of working viscosities is from about 2.5 to 4.5. In FIG. 1, the best temperature range expressed in terms of reciprocal temperature is between approximately 8.2 and 10.0. This corresponds to shaping temperatures of about 1350° F. to 1750° F., which temperature range has been found particularly satisfactory for the isothermal forging and sizing of titanium and titanium alloy workpieces in super alloy dies using the improved lubricant compositions hereof. The "forging window" is defined in the graph shown in FIG. 1 between the viscosity limits of a minimum of about 2.5 to a maximum of about 4.5 expressed as the logarithm of the viscosity in terms of poises and between the operating temperatures of 1350° F. and 1750° F.

The term "reciprocal temperature" is one of convenience so that the resultant curves for the various vitreous materials will appear as nearly straight lines. "Reciprocal temperature" is defined as 10,000 divided by the absolute temperature of shaping expressed in degrees Kelvin. Thus, the "forging window" is a rectangular zone located between the drip point viscosity and a working viscosity less than the softening point viscosity. Any glass composition falling within that zone for the particular shaping operation to be performed may be used, giving due consideration to reactivity with the workpiece, contamination of the workpiece or dies, reactivity with the die materials, and the like. Each system (i.e., die material and workpiece material) has its own "forging window" which, for the most part, will vary laterally on the chart of FIG. 1 with the temperature of the shaping operation.

As a typical example, potassium borosilicate(6%) is an acceptable vitreous material for use as the vitreous phase of the lubricant and separation compositions of the present invention. Within the temperature range of 1500° F. to 1700° F., potassium borosilicate (6%) shows a viscosity curve which is acceptably within the "forging window". A 2% alumina borosilicate glass is outside of the "forging window" for titanium alloy metal being worked in nickel-chromium super alloy dies. It may, however, be within the "forging window" for use in dies or with metals where higher temperatures of forging and/or sizing can be utilized.

The vertical black bars in the annexed drawings are illustrative of desired work ranges at the indicated temperatures wherein the glasses utilized have the properties which render them useful. If the viscosity curve crosses the black line within the "forging window" outlined in dotted lines for the present subject matter at the predetermined forging temperature, the glass may be used. Secondary considerations involve, of course, reactivity of the glass with the workpiece and/or dies, contamination of the workpiece, and/or dies. Sulphur or arsenic containing vitreous materials and those containing appreciable precentages of alkali metal oxides are deleterious and are generally avoided in titanium metal forging for contamination and die life reasons.

The dotted line across the top of the graph is indicative of the viscosity at the softening point of the glass. The working point is shown by a horizontal dotted line at a viscosity value of approximately 4.0. Satisfactory results are obtained in general in the abscissa range of from about 2.0 to about 4.5, the preferred range being from about 2.8 to 4.2.

that the working characteristics of the vitreous component under isothermal shaping conditions is within the "forging window" illustrated in FIG. 1. Commercially available glass frits which we have used in carrying out our process have had a particle size of approximately 60 mesh. Use of these compositions has resulted in production pieces which are commercially unsatisfactory. The vitreous component is dispersed in a similar organic medium to that supplied with the graphite suspension. The organic materials utilized need not be the same as those present in the suspension of the solid lubricant. They should, however, be compatible therewith.

We have found that a precoat composition formed from such commercially available vitreous materials, e.g. a borosilicate glass frit V-11 in Table I below, ball milled for a period of 24 hours at a solids concentration of between 15% to 35% by weight in the organic medium or carrier liquid and utilizing ceramic balls, produces a vitreous component which has a particle size such that less than about 2% of the vitreous component is retained upon a 200 mesh screen, U.S. standard sieve sizes. Formulation with a graphite suspension and application of the resulting precoat composition to the workpiece surface in accordance with the procedure set forth above results in surface characteristics which are commercially acceptable. It is preferred that the vitreous component undergo size reduction separately from the solid lubricant which already has a very fine particle size. The materials may, however, be ground together if desired.

TABLE I

COMPOSITION OF VITREOUS MATERIALS IN % BY WEIGHT

| | Example Numbers | | | | | | | | | | | |
|---|---|---|---|---|---|---|---|---|---|---|---|---|
| Metal Oxides | V-1 | V-2 | V-3 | V-4 | V-5 | V-6 | V-7 | V-8 | V-9 | V-10 | V-11 | V-12 |
| $SiO_2$ | 71.9 | 81 | 71 | 73 | 34.4 | 66.4 | 61.1 | 41.2 | 40.8 | 20.3 | 31.0 | 42.0 |
| $Al_2O_3$ | | 2 | 1 | 1 | | | | | | | | |
| $B_2O_3$ | 6.0 | 13 | 12 | | | 13.0 | 3.8 | | 11.4 | | 60.0 | |
| $Na_2O$ | 14.7 | 4 | 5 | 17 | | | 2.8 | 0.7 | | | | 2.0 |
| $K_2O$ | 5.2 | | | | 3.2 | 6.2 | 10.3 | 6.5 | | 0.4 | 7.0 | 6.0 |
| MgO | | | | 4 | | | | | | | | |
| CaO | 2.2 | | | 5 | | | | | 3.6 | | | |
| PbO | | | | | 62.4 | 14.4 | | 51.1 | | 79.3 | | 49.0 |
| BaO | | | | | | | 17.9 | | 44.2 | | | |
| ZnO | | | 11 | | | | 4.1 | | | | | |
| $Li_2O$ | | | | | | | | | | | | 1.0 |
| CoO | | | | | | | | | | | 2.0 | |
| $As_2O_3$ | | | | | | | | 0.5 | | | | |

The following table sets forth illustrative examples of vitreous compositions suitable for use in accordance herewith. For most purposes, the vitreous materials contain substantial amounts, i.e., 30% to 70% by weight of the glass, of silica, boron oxide, or a mixture of silicon and boron oxides. The "V" numbers correspond to Table I below.

At high forging temperatures, e.g., 1700° F. the alkali metal oxides tend to be corrosive to superalloy die materials and hence the alkali metal oxide content is desirably limited to less than 5% and preferably below 2%.

The metal oxide or mixture of metal oxides from which the vitreous component is made, are used as finely divided materials. The average particle size of the vitreous material should be within the broad range of 1 to 74 microns, and preferably from 2 to 40 microns. A convenient and useful screen size is −325 mesh.

The vitreous component is available commercially as a glass frit which may have a wide variety of chemical composition such as set forth in the table below. The composition of the vitreous component is selected with the isothermal forging or sizing conditions in mind so

THE SOLID LUBRICANT

As indicated above, the solid lubricant portion of the lubricant compositions of the present invention is graphite, boron nitride, or mixtures of graphite and boron nitride. Graphite is preferred as there is a tendency to build up in the dies when boron nitride is used.

The solid lubricant may be blended into the final precoat composition in dry powdered form, or used as commercially available dispersions of the solid lubricant in an organic solvent medium, e.g., alcohol, xylene, aliphatic hydrocarbons or the like. These dispersions may include a resinous binder, such as a polymethyl silicon resin. Organic suspending agents may be included in the dispersions to improve the stability of the dispersions. These agents are also thermally decomposed or volatilized during the preheating of the workpiece.

A commercially available material which is a suspension of extremely finely divided graphite (minus 200 mesh) in alcohol is Acheson #154 which contains from 20% solids in an isopropanol vehicle. The particle size of the graphite is in general 10 microns and under, and for best results ranges between 6 microns and 0.5 micron. The graphite is electric furnace graphite.

PRECOAT COMPONENTS

The above described essential components of the compositions of the present invention are those which exist under forging or sizing conditions. In order to apply the compositions of the present invention to the workpiece prior to shaping, it has been found convenient to suspend the vitreous material and the solid lubricant material in an organic medium or carrier liquid. This enables the lubricating composition to be applied by a convenient method such as brushing, spraying, dipping, or the like. For application by such methods, a solids concentration (including the resin) should be from 10% to 30% by weight. The chemical nature of the organic materials is unimportant so long as they produce a suitable system in which to apply the forging lubricant to the workpiece surface. The precoat ingredients include, therefore, an organic solvent and/or diluent and a resinous material as the carrier medium. The solvent is removed from the workpiece by evaporation during a preliminary preheat cycle, and the resinous material or binder is removed by thermal decomposition during the final preheat cycle. The resinous binder material is preferably a noncharring resin at decomposition temperatures and one that has good "green strength" after low temperature preheating of the coated workpiece at 150° F. to 250° F., e.g., 180°-200° F. This enables transfer of the preheated workpiece to an oven for preheating to attain a temperature near shaping temperature.

The solvent component will be determined by the nature of the resinous binder material and the amount by the selected mode of application. Any volatile solvent or solvent/diluent composition may be used so long as it dissolves or extends the resinous material. For example, if the resinous binder material is a polymethylacrylate, a suitable solvent is methyl acrylate monomer or isopropyl alcohol or xylene. If the organic resinous binder material is an acrylonitrile derivative, acrylonitrile monomer may be used as the solvent. If polystyrene is the binder material, monomeric styrene may be used as the solvent. Numerous other resinous materials are thus available for use and suitable solvents and diluents therefore are well known. Inasmuch as the solvent and/or diluent is nonreactive with any of the other components of the lubricant compositions, its chemical and physical nature is of importance only with respect to the resin used as a binder. All organics disappear from the composition during the preheating of the coated workpiece to near the shaping temperature. Aromatic solvents such as xylene, toluene, benzene may be used; alcohols such as isopropyl alcohol, ethyl alcohol, and the like may be used; ethers, such as butyl cellosolve may be used; hydrocarbon diluents such as mineral spirits, naphtha, cyclohexane, etc. may be used.

Organic resinous materials in addition to those heat fugitive binders mentioned above which may be used include polyethylene, polybutene, polypropylene, polyvinylchloride, silicone resins, epoxy resins, alkyd resins, oil modified alkyd resins, drying oils, e.g. linseed oil and the like. The silicone resins are particularly suitable because they decompose to $SiO_2$, a useful vitreous material. Non-charring resins are preferred.

In formulating the compositions of the present invention, the glass or vitreous material and the solid lubricant material are present as inorganic particulate materials, the solid lubricant to glass or vitreous component ratio being at least 1:1 up to 9.5:1. As these ingredients are insoluble in the system, they must be dispersed in the organic medium in an amount sufficient to yield a sprayable, brushable, or liquid bath composition for dipping or immersion of the workpiece. Formulation of the compositions to any of these modes of application is well known to those skilled in the art, and will be readily apparent from the specific examples which follow. Generally 5% to 30% lubricant solids (including the resin) precoat composition will be found useful for spraying, brushing, or dipping. Higher solids concentrations, e.g., about 40%, may be used for other modes of application, e.g., knife coating, if desired. Agitation of the bulk precoat material is, of course, desired to limit settling and separation of the solid portions during application.

SPECIFIC EXAMPLES AND MODE OF USING

The lubricant composition itself remains after evaporation of the solvent and thermal decomposition or depolymerization of the binder material. The residue is composed of the glass component in an equal or minor amount, i.e. less than 50%, and preferably below about 40%, with the solid lubricant material constituting the balance. Minor amounts of other materials may be present, but such ingredients have not been found to be necessary. The concentration of the solid lubricant will vary slightly depending on whether the isothermal shaping operation is forging or sizing, more solid lubricant being used in sizing then in forging.

It should also be understood that the following specific examples are primarily useful in the field of isothermal forging and sizing of titanium or titanium alloys in super alloy dies. These examples are for illustrative purposes only and it is to be understood that the principles of the present invention may be applied to the forging or sizing of other metals in dies of other composition under other conditions. Those skilled in the art will be enabled by the present disclosure to formulate numerous additional examples of lubrication separation compositions for various shaping problems utilizing the concepts of the forging window and critical particle size for the glass component and, formulating a vitreous phase including a solid lubricant material as a material for improving the relative moveability of the surface of the workpiece with respect to the surface of the die.

EXAMPLE I

A preferred 51% graphite precoat composition has the following formulation:

| | |
|---|---|
| xylene | 140.1 grams |
| diboron trioxide | 10.7 grams |
| borosilicate glass frit (−200 mesh with CoO) Example V-11 | 2.7 grams |
| polymethyl siloxane binder | 24.8 grams |
| electric furnace graphite (−10 microns) | 21.7 grams |

Prior to formulation, the binder, the $B_2O_3$, the frit and a portion of the xylene were ball milled for 24 hours using ceramic balls to a grind of −200 mesh. The graphite dispersion was added and xylene added to a solids content 30% (including the resin). The binder was found to decompose to leave a residue of 7.7 grams of silica.

This precoat in bulk was agitated with air to maintain the suspension and a titanium alloy aircraft part preheated to about 100° F. immersed in the composition. The coating was allowed to dry in air.

The part was then isothermally forged in superalloy dies in accordance with the procedure outlined below. The part was then in "net" shape. The procedure was repeated using sizing dies of superalloy composition to the final size. The resultant shaped product was free of surface blemishes and was commercially acceptable.

EXAMPLE II

A preferred precoat sizing composition containing graphite and vitreous components in a 7.1:1 ratio is as follows:

| | |
|---|---|
| xylene | 146.8 grams |
| diboron trioxide (−200 mesh) | 3.0 grams |
| borosilociate glass frit (CoO) (−200 mesh) | .8 grams |
| polymethyl methacrylate | 6.8 grams |
| polymethyl siloxane | 6.9 grams |
| electric furnace graphite (−6 microns) | 35.7 grams |

This composition is especially suited to isothermal sizing and may be used following Example I above for the final isothermal sizing operation. The siloxane portion of the binder decomposes to leave a residue of 2.1 gms. of silica.

EXAMPLE III

A sprayable precoat composition for isothermal forging which includes graphite and vitreous components in a weight ratio of about 5.0:1 is as follows:

| | |
|---|---|
| xylene | 152.00 grams |
| diboron trioxide (−200 mesh) | 4.9 grams |
| borosilicate glass frit (CoO) (−200 mesh) | 1.3 grams |
| polystyrene | 11.3 grams |
| electric furnace graphite | 30.6 grams |

EXAMPLE IV

This composition is especially useful for isothermal forging at the upper end of the temperature range. A thicker coating is applied to the workpiece. The ratio of graphite to vitreous materials is about 3.9:1.

| | |
|---|---|
| Toluene | 120.0 grams |
| $B_2O_3$ (−200 mesh) | 6.1 grams |
| borosilicate glass frit (−200 mesh) | 4.1 grams |
| cellulose nitrate | 9.4 grams |
| polymethyl siloxane | 9.4 grams |
| electric furnace graphite | 51.0 grams |

EXAMPLE V

This is another example of an isothermal forging composition showing a 9.5:1 graphite to vitreous components ratio.

| | |
|---|---|
| Mineral spirits | 144.65 grams |
| $B_2O_3$ (−200 mesh) | 2.7 grams |

-continued

| | |
|---|---|
| borosilicate glass frit (CoO) (−200 mesh) | 1.5 grams |
| Cellulose nitrate | 11.25 grams |
| electric furnace graphite (−6 microns) | 39.9 grams |

EXAMPLE VI

This example illustrates a mixed binder system and mixed graphite-boron nitride solid lubricant. The ratio of solid lubricant to vitreous material is 1.7:1.

| | |
|---|---|
| Tolvene | 146.2 grams |
| $B_2O_3$ (−200 mesh) | 8.3 grams |
| $SiO_2$ (−325 mesh) | 2.09 grams |
| Polymethyl siloxane | 10.25 grams |
| Polybutene | 10.25 grams |
| Graphite L10u (electric furnace) | 11.45 grams |
| BN L7u | 11.48 grams |

EXAMPLE V

This example illustrates a boron nitride solid lubricant system, the ratio of solid lubricant to vitreous components being 3:1.

| | |
|---|---|
| Xylene | 154.64 |
| $B_2O_3$ (−200 mesh) | 6.63 |
| $SiO_2$ (−325 mesh) | 1.67 |
| Cellulose nitrate | 12.76 |
| BN (L7u) | 24.29 |

In use, the precoat composition properly selected for the temperature of shaping is applied to the workpiece as one or more coats, e.g., 3 applications. A coating thickness prior to firing of from about 1 to 15 mils is satisfactory. The wet workpiece is then dried in an oven at a temperature sufficient to remove solvent and/or diluent and set the resinous component. The resin used may be one which cures by heat, e.g., a B-stage phenol-formaldehyde resin. The oven temperature is in the range of from 150° F. to 250° F. preferably 180° F. to 230° F. the latter range being especially suitable for a polymethylmethacrylate resin binder. This provides a precoated workpiece in which the "green strength" of the coating of precoated workpiece is sufficient to allow handling thereof with tongs, for example without penetration of the coating.

The workpiece is then heated in a furnace to a temperature of 1000° F. to 1400° F. for from 1 to 30 minutes depending on the size of the workpiece to decompose the organic portion of the coating and leave the glass-/solid lubricant composition on the surface. A polymethylmethacrylate (Plexiglas) binder, for example, leaves no char residue on thermal decomposition under these conditions. A silicone resin decomposes to leave a residue of silica which is quite compatible in the system and is accounted for in the initial formulation as a part of the glass or vitreous portion of the lubricant composition. Non-charring resins are, however, preferred as the organic binder. The thermal decomposition process preheats the coated workpiece to near forging temperature and minimizes the time required to achieve forging temperature in the heated dies. With the high graphite lubricant compositions hereof, this preheating step is very important. The workpiece is then transferred to the die system, e.g., a horizontally split 2-piece die. Thereafter, the die-workpiece assembly attains the shaping temperature and pressure from a hydraulic source applied to the workpiece until shaping or sizing is complete and the workpiece is stress relieved.

Thereafter, the pressure is released and the part released from the die. It may then be cooled at a controlled rate, or spontaneously air cooled. The part is then cleaned by sand blasting, immersion in molten salt, or other chemical means. The cycle may then be repeated.

A specific example of a Ti—6Al—4V titanium alloy analyzes 0.10 max C; 0.05 max N; 0.30 max Fe; 5.50–6.75 Al; 3.50–4.50 V.; 0.20 max O; 0.0125 max H; bal. Ti. A typical nickel-base superalloy die material analyzes 0.18 C; 10.0 Cr; 15.0 Co.; 3.0 Mo; 4.7 Ti; 5.5 Al; 0.014 B; 0.06 Zr; 1.0 V; bal. Ni, and has a melting point in the range of 2305°–2435° F. A typical iron base superalloy die material analyzes 0.05 C; 1.35 Mn; 0.50 Si; 15.0 Cr; 26.0 Ni; 1.3 Mo; 2.0 Ti; 0.2 Al; 0.015 B; balance Fe, and has a melting point of 2500°–2550° F.

With reference to the weight ratio of the solid lubricant to the ceramic material in the lubricant compositions, those compositions where the solid lubricant is present in an amount from 50% up to about 85% by weight are especially adapted to isothermal forging conditions wherein considerable new surface is generated in the forging operation and a substantial amount of metal is moved.

For isothermal sizing operations, we prefer to utilize from about 75% to 95% of the solid lubricant relative to the vitreous or ceramic material. In isothermal sizing, relatively small amounts of metal are moved and little or no new surface is generated. In each case, preheating of the coated workpiece for 5 to 60 minutes at at least 1300° F. is important to the production of commercially acceptable workpieces.

We are not aware of the reason why the particle size reduction of the vitreous component improves the process of isothermal shaping, particularly when it is considered that the vitreous component is a liquid vehicle for the solid lubricant under the conditions of isothermal forging or sizing. Nevertheless, the size reduction of the vitreous component has been found to materially increase the proportion of commercially acceptable pieces produced relative to the number of commercially acceptable pieces previously produced.

While ball milling has been illustrated above as one means of reducing the particle size of the vitreous component, any suitable milling procedure such as impact dry grinding in a "Micronizer", or dispersion grinding in a "sandmill" (see Hochberg U.S. Pat. No. 2,581,414) may be used.

We claim:

1. A process for isothermally shaping a titanium-containing metal workpiece in a hot die including the steps of providing a precoat separation lubrication composition which is a liquid dispersion of a vitreous component and a finely divided solid lubricant selected from graphite, boron nitride and mixtures of graphite and boron nitride in a solution of an organic solvent and a resin binder soluble in said solvent and wherein the particle size of the vitreous component and the solid lubricant is less than about 200 mesh, U.S. Standard sieve size, and the weight ratio of solid lubricant to vitreous component is at least 1:1, said vitreous component having a melting point above 800° F. and below the temperature of isothermal shaping, coating said workpiece with said precoat composition, heating said workpiece to attain a temperature between 1000° F. and 1400° F. for from 1 to 30 minutes to volatilize the organic solvent and thermally decompose the resin binder to leave a residue of vitreous material and solid lubricant on said workpiece, transferring the workpiece in a preheated die system, attaining a temperature of from 1350° F. to 1750° F. and loading said die to alter the shape of said workpiece.

2. A process in accordance with claim 1 in which the solid lubricant is graphite.

3. A process for isothermally forging a titanium-containing metal workpiece in a hot superalloy die including the step of providing a precoat separation lubrication composition which is a liquid dispersion of a vitreous component and graphite in a solution of an organic solvent and a resin binder soluble in said solvent and wherein the graphite size of the vitreous component and the graphite is less than about 200 mesh, U.S. Standard sieve size, and the weight ratio of the graphite to the vitreous component is from 1:1 to 5.67:1, said vitreous component having a melting point above 800° F. and less than the temperature of isothermal forging, coating said workpiece with said precoat lubricant composition, heating said workpiece to attain a temperature between 1000° F. and 1400° F. for from 1 to 30 minutes to volatilize the organic solvent and thermally decompose the resin binder to leave a residue of vitreous material and graphite on said workpiece, transferring the workpiece in a preheated die system, attaining a temperature of from 1350° F. to 1750° F., and loading said die to forge said workpiece.

4. A process for isothermally sizing a titanium-containing metal workpiece in a hot superalloy die including the steps of providing a precoat separation lubrication composition which is a liquid dispersion of a vitreous component and graphite in a solution of an organic solvent and a resin binder soluble in said solvent and wherein the particle size of the vitreous component and the graphite is less than about 200 mesh, U.S. Standard sieve size, and the weight ratio of the graphite to the vitreous component is from 1:1 to 9.5:1, coating said workpiece with said precoat lubricant composition, heating said workpiece to attain a temperature between 1000° F. and 1400° F. for from 1 to 30 minutes to volatilize the organic solvent and thermally decompose the resin binder to leave a residue of vitreous material and graphite on said workpiece, transferring the workpiece into a preheated sizing die system, attaining a temperature of from 1350° F. to 1750° F. and loading said die to shape said workpiece to its final size.

5. A process according to any of claims 1, 2, 3, and 4 wherein the vitreous component includes $B_2O_3$ and $SiO_2$.

6. A process according to any of claims 1, 2, 3, and 4 wherein the precoat lubricant composition as applied to the workpiece is from 5% to 30% by weight of combined vitreous component and graphite, with the balance being organic solvent and resin binder.

7. A process according to any of claims 1, 2, 3, and 4 wherein the particle size of the vitreous component and the graphite is 10 microns.

8. A process according to any of claims 1, 2, 3, and 4 wherein the resin binder is a polymethyl silicone resin.

9. A process according to any of claims 1, 2, 3, and 4 wherein the resin binder is a polymethyl methacrylate resin.

10. A process according to claims 1, 2, 3, and 4 wherein the resin binder is a polystyrene resin.

11. A process according to any of claims 1, 2, 3, and 4 wherein the resin binder is a polybutene resin.

* * * * *

UNITED STATES PATENT AND TRADEMARK OFFICE

CERTIFICATE OF CORRECTION

PATENT NO. : 4,281,528

DATED : August 4, 1981

INVENTOR(S) : Spiegelberg et al.

It is certified that error appears in the above-identified patent and that said Letters Patent are hereby corrected as shown below:

Column 12, line 16, change "graphite" to --particle--.

Signed and Sealed this

Eighth Day of December 1981

[SEAL]

Attest:

GERALD J. MOSSINGHOFF

Attesting Officer

Commissioner of Patents and Trademarks